US005158211A

United States Patent [19]

Meshberg

[11] Patent Number: 5,158,211

[45] Date of Patent: Oct. 27, 1992

[54] FLUID DISPENSING UNIT RETAINER

[76] Inventor: Philip Meshberg, 2500 S. Ocean Blvd., Bldg. 3, Apartment 1-A, Palm Beach, Fla. 33480

[21] Appl. No.: 577,303

[22] Filed: Aug. 30, 1990

[51] Int. Cl.[5] ..... B67D 5/32

[52] U.S. Cl. ..... 222/153; 222/321; 222/384

[58] Field of Search ..... 222/153, 182, 321, 383, 222/384, 385, 402.11, 402.12, 148.149, 150, 151

[56] References Cited

U.S. PATENT DOCUMENTS

| | | | |
|---|---|---|---|
| 1,264,554 | 4/1918 | Peron | 222/385 |
| 1,679,305 | 7/1928 | Heller | 222/321 |
| 2,586,687 | 2/1952 | Mellon | 222/321 |
| 2,861,839 | 11/1958 | Mellon | 222/385 |
| 3,129,854 | 4/1964 | Boehm et al. | 222/321 |
| 3,173,585 | 3/1965 | Kahn | 222/394 |
| 3,211,346 | 10/1965 | Meshberg | 222/321 |
| 3,429,310 | 2/1969 | Jaffe et al. | 222/182 |
| 3,484,023 | 12/1969 | Meshberg | 222/402.11 |
| 3,848,778 | 11/1974 | Meshberg | 222/402.11 |
| 3,904,088 | 9/1975 | Milbourne, Sr. | 222/402.11 |
| 3,920,164 | 11/1975 | Lindsoe | 222/385 |
| 4,008,830 | 2/1977 | Meshberg | 222/95 |
| 4.230,242 | 10/1980 | Meshberg | 222/321 |
| 4,274,560 | 6/1981 | Cater | 222/321 |
| 4,324,351 | 4/1982 | Meshberg | 222/402.11 |
| 4,457,454 | 7/1984 | Meshberg | 222/95 |
| 4,457,455 | 7/1984 | Meshberg | 222/105 |
| 4,696,415 | 9/1987 | Meshberg | 222/82 |
| 4,899,913 | 2/1990 | Ruscitti et al. | 222/321 |

FOREIGN PATENT DOCUMENTS

| | | | |
|---|---|---|---|
| 32650 | 4/1908 | Austria | 222/385 |
| 187314 | 12/1985 | European Pat. Off. . | |
| 8702986 | 5/1987 | Fed. Rep. of Germany . | |
| 8903363 | 4/1989 | PCT Int'l Appl. | 222/153 |

*Primary Examiner*—Andres Kashnikow
*Assistant Examiner*—Kenneth Bomberg
*Attorney, Agent, or Firm*—Kenyon & Kenyon

[57] ABSTRACT

A dispensing unit retainer is formed with a tapered surface into which a dispensing unit, such as a modular pump or the like, is permanently retained with an interference fit. Axially inward movement of the modular pump is limited by a shoulder formed at the inner end of the tapered surface. The retainer can be integrally formed with a container. Once installed in the retainer, the dispensing unit cannot be removed without damage to the retainer or dispensing unit. An upstanding annular wall concentrically surrounding the surface includes an inwardly extending projection for sealing the discharge orifice of the dispensing unit actuator and two axially extending openings cooperating with the actuator to inhibit accidental discharge of the dispensing unit.

9 Claims, 11 Drawing Sheets

FLUID DISPENSING UNIT RETAINER

BACKGROUND OF THE INVENTION

This invention relates to fluid dispensers in general, and more particularly to an improved dispensing unit retainer for permanently retaining a top-mounted dispensing unit such as a pump, valve, or the like.

Fluid product dispensers are frequently fitted with fluid dispensing units. The term "dispensing unit" as used herein means a pump, valve, or any type of device for dispensing product from a container. One type of pump for which several embodiments of the present invention are particularly well adapted is a modular pump, which is a self-contained structure that may be assembled and shipped separately from the rest of the dispenser.

Many packages for drugs and other food products use tamper-proof seals to prevent the introduction of foreign substances into the product during storage, display, or any other time before purchase by the consumer. However, once the container is open, there is little protection against tampering or contamination. There is a need for a container that cannot be tampered with at any time without destroying the container and its contents. Such a container is needed for dispensive medications, as well as liquid food.

Currently available dispensers are formed from containers, typically glass or plastic bottles, having a conventional pump dispenser fitted in a dispensing unit retainer such as a threaded cap or similar closure member. FIG. 4 of my prior U.S. Pat No. 4,457,455 discloses the combination of a non-vented pump, which may be of the nature disclosed in U.S. Pat. Nos. 3,211,346 or 4,274,560, and a screw threaded cap. In my prior U.S. Pat. No. 4,230,242 the combination of a pre-pressurized pump and a screw-threaded container cap is used to close the end of the container. Such containers are susceptible to tampering because the threaded cap or dispensing unit is readily removable. Although some designs for hermetically sealed containers provide some of the desired tamper-proof characteristics, such as initially holding the product in a separate protected or hermetically sealed collapsible compartment as is disclosed in my prior U.S. Pat. Nos. 4,008,830, 4,457,454, 4,457,455 and 4,696,415, these pumps are expensive to manufacture and equipment for the efficient mass production of such containers is not currently available.

Another drawback of the threaded-cap type of container is that the dispensing unit is typically mounted in the cap from the underside of the cap. In addition to complicating assembly, during operation of the dispensing unit, the user presses inwardly on the dispensing unit; the operating force acts in a direction tending to dislodge the dispensing unit from the cap.

Yet another shortcoming of conventional dispensers is that they are susceptible to accidental discharge or discharge by children with potentially harmful results. My prior U.S. Pat. Nos. 3,848,778 and 4,324,351 disclose features to prevent accidental discharge and operation by children. Both patents disclose a dispenser actuator that swivels on the stem of the dispensing unit between a position in which the dispensing unit can be operated and a position in which it cannot. U.S. Pat. No. 3,848,778 also discloses a locking tab that engages the actuator when it is in the non-operating position; the locking tab must be disabled before the actuator can be rotated to the operating position. The patent also discloses a breakaway tab that must be removed before the locking tab can be disabled.

Finally, the discharge orifice of conventional dispensing unit actuators are susceptible to clogging when some of the discharged product that remains in the fluid passages leading to the discharge orifice dries in the orifice from exposure to ambient air.

Thus, there is a need for a dispensing unit retainer that can be fitted with a dispensing unit and can be joined with a container to make a more completely tamper-proof dispensing container, which is more easily assembled to the container than heretofore possible, which renders the container resistant to accidental discharge or discharge by a child, and which inhibits clogging of the actuator discharge orifice by dried product.

SUMMARY OF THE INVENTION

The present invention satisfies this need by providing a dispensing unit retainer for permanently retaining a dispensing unit and having tamper resistant, child resistant, and orifice sealing features. The retainer includes a horizontal portion having a radially inner periphery and a radially outer periphery from which a container sidewall portion depends downwardly toward the interior of the container. The sidewall may be integrally formed with the wall of a container. An axially-oriented circumferential surface is defined by the radially inner periphery of the horizontal portion. The surface tapers radially inwardly from the outer end of the surface to the inner end.. A dispensing unit, such as a modular pump, may be pressed into the surface from the outside of the container, which permanently retains it in place via an interference fit in the surface. The pump may not be positioned axially past a stop formed at the axially inner end of the surface and cannot be removed without destroying the container and its contents. The retainer may be molded of plastic in one piece and may be integrally formed with a container.

The retainer is further formed with an upstanding annular wall depending upwardly from the horizontal portion. The actuator, mounted on the dispensing unit, is slidably received in the upstanding annular wall and is rotatably mounted on the stem of the dispensing unit for movement between an operating position and a non-operating position. The actuator is formed with an actuating portion for operating the dispensing unit, a dispensing orifice, and an extension extending laterally over the axially outer end of the upstanding annular wall. The extension is used to rotate the actuator between the operating and non-operating positions. The wall includes a radially inwardly extending projection that mates with, and seals, the discharge orifice of the actuator when the actuator is in a non-operating position. The projection can be formed on a tab that is hinged from the wall.

The wall can further be formed with a pair of axially-extending openings that cooperate with an actuator to inhibit accidental discharge of the dispensing unit. The opening through which the dispensing unit discharges product when the actuator is in an operating position can be covered by a removable tab initially connected to the upstanding annular wall.

The retainer of the invention has several advantages over prior retainers. The dispensing unit can be installed from the top of the retainer, thereby simplifying assembly. The retainer can be integrally formed with a container to produce a more completely tamper-proof dispenser because the dispensing unit, which seals the open end of the container when in place, cannot be removed from the container without damaging the container. Furthermore, operation of the dispensing unit will not tend to dislodge the dispensing unit into the container because the stop in the tapered surface axially fixes the dispensing unit in position. The retainer of the invention may be produced with an integrally molded container on conventional plastic blow molding machines and can be filled with product on conventional filling equipment.

Product cannot be dispensed when the actuator is in the non-dispensing position or before the removable tab is removed from the opening through which the actuator dispenses product. Finally, clogging of the discharge orifice of the actuator from dried product residue is inhibited by sealing the discharge orifice with the radially inwardly extending projection.

Many of the features of the invention can advantageously be employed separately in combination with existing dispenser designs. The retainer can be formed with conventional thread or snap structures for attachment to the body of the container as a mounting cap. Of course, the container would not be tamper resistant because the mounting cap could be removed from the body of the container. However, the other advantages described above would be retained.

The structure for retaining a modular pump mounted from the axially outer side can be employed in either a mounting cap embodiment or an integral container neck embodiment without the upstanding annular wall and its associated hinged tab, removable tab, and actuator locking structures. Conversely, in a mounting cap embodiment, the annular wall and associated structures can be employed with a conventional pump retention structure in which a non-modular dispensing pump is mounted in the mounting cap from its axially inner side before assembly onto the container body.

DETAILED DESCRIPTION

Figure 1:
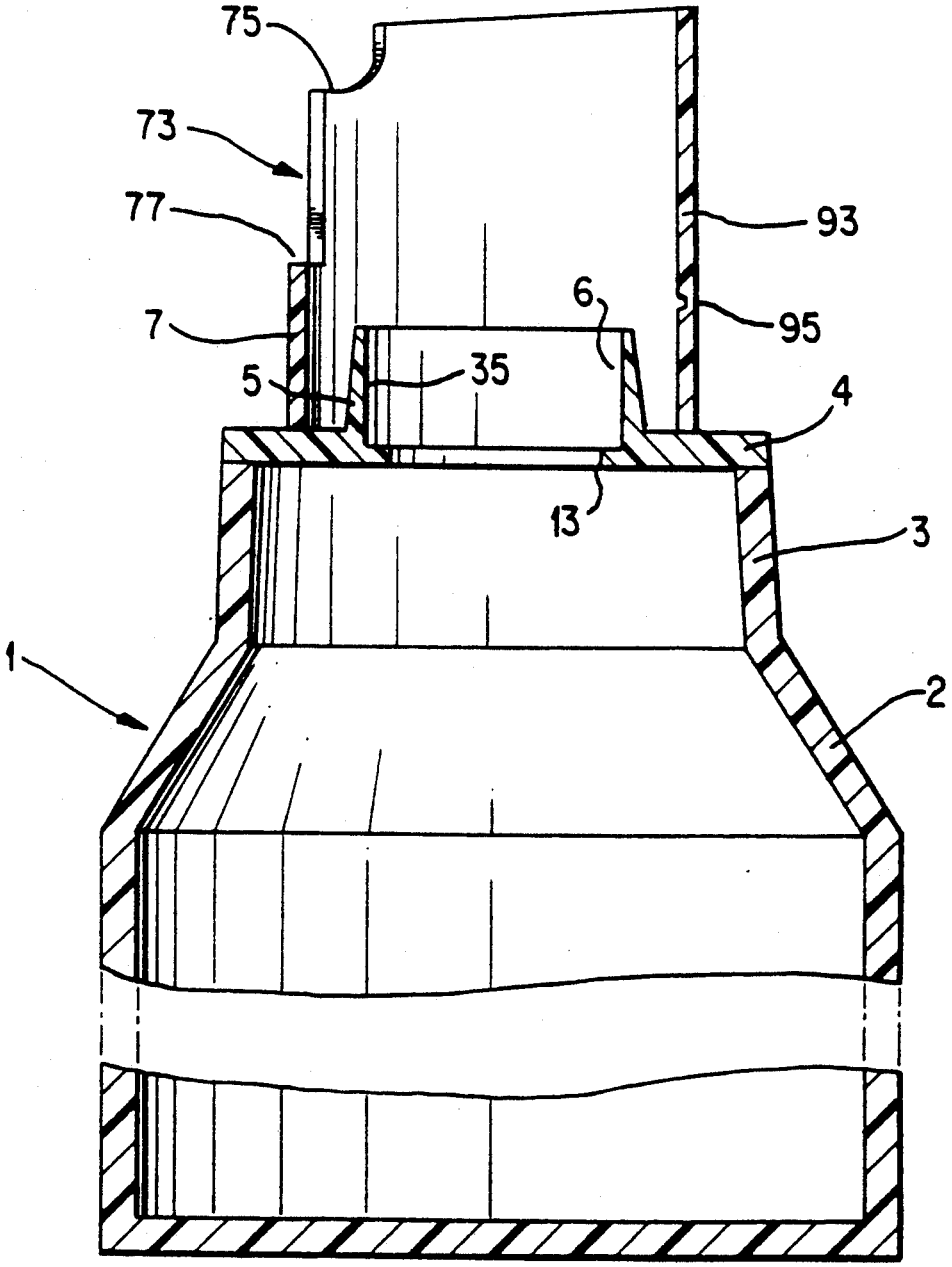
FIG. 1 is a cross sectional view of a integrally formed container and retainer constructed according to the principles of a first embodiment of the invention.
Figure 2:
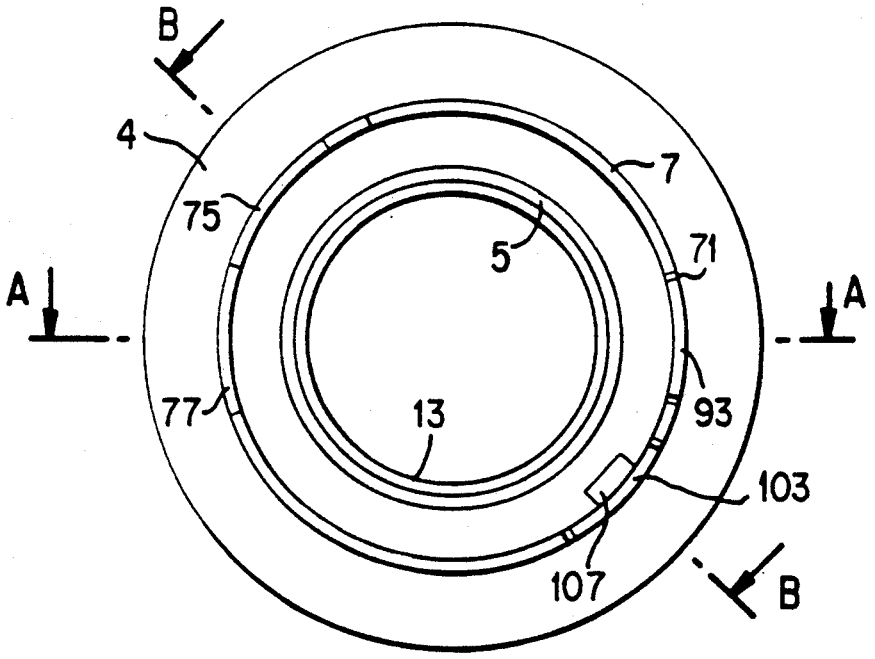
FIG. 2 is a top plan view of the retainer shown in FIG. 1 in which the tapered nature of the walls is not shown for purposes of clarity.
Figure 4:
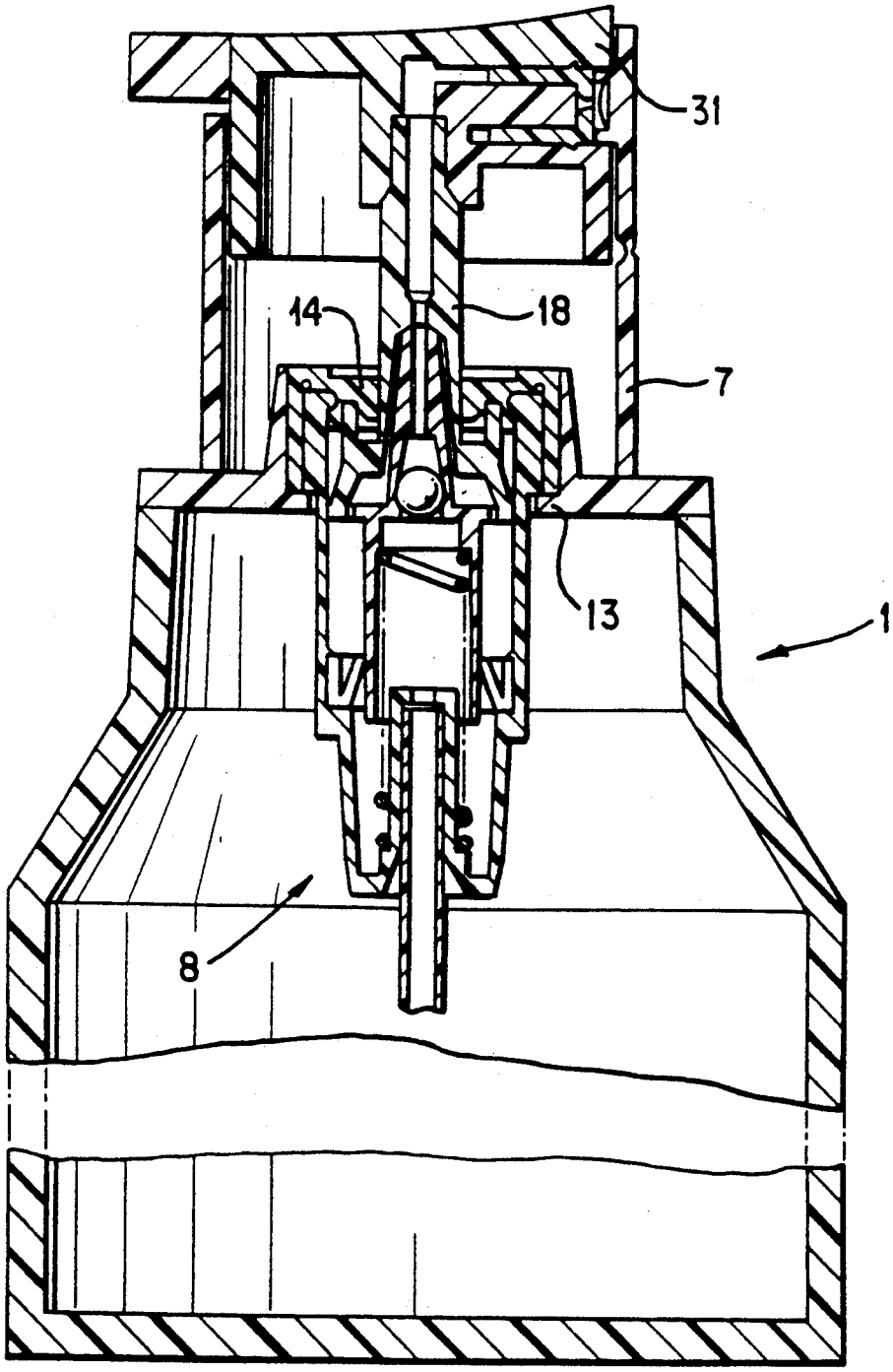
FIG. 4 is a cross sectional view of the container and retainer of a first embodiment of the invention with a prepressurized pressurized type modular pump installed in the retainer.

FIGS. 1 and 2 illustrate a retainer and integral container 1 constructed in accordance with the present invention. The retainer is specially formed for permanently retaining a dispensing unit, such as a pump, valve, or the like, for dispensing a fluid product from the integral container. In the illustrated embodiments, the dispensing unit is a modular pump. As shown in FIG. 1, which is a cross section of the container and retainer along the line A—A in FIG. 2, the container and retainer 1 may be formed as a single molded piece 2 of a plastic material by conventional molding techniques. The axially inner end of the container is enclosed, while the axially outer end forms the retainer including a horizontal portion 4. The horizontal portion 4 is integrally formed with sidewall 3 of the container. Integrally formed with horizontal portion 4 at its inner periphery is a vertical wall 5 defining a central surface 6 formed in the retainer for receiving a dispensing unit. The central surface 6 is specially formed to receive and permanently retain a modular pump 8, as shown in FIG. 4 and discussed in more detail below. The term "permanently retain" means that the pump cannot be removed once it is press fit into the retainer without destroying the container and its contents. The surface 6 continuously tapers from an inside diameter at its axially outer end to a slightly smaller inside diameter at its axially inner end.

Figure 5:
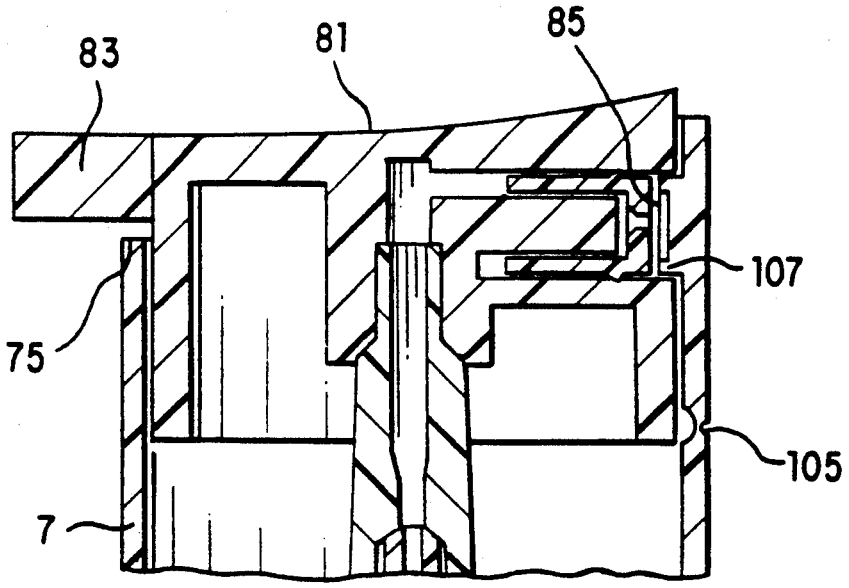
FIG. 5 is a partial cross sectional view of the container and retainer shown in FIG. 4 shown in enlarged scale, with the actuator in a non-operating position.
Figure 6:
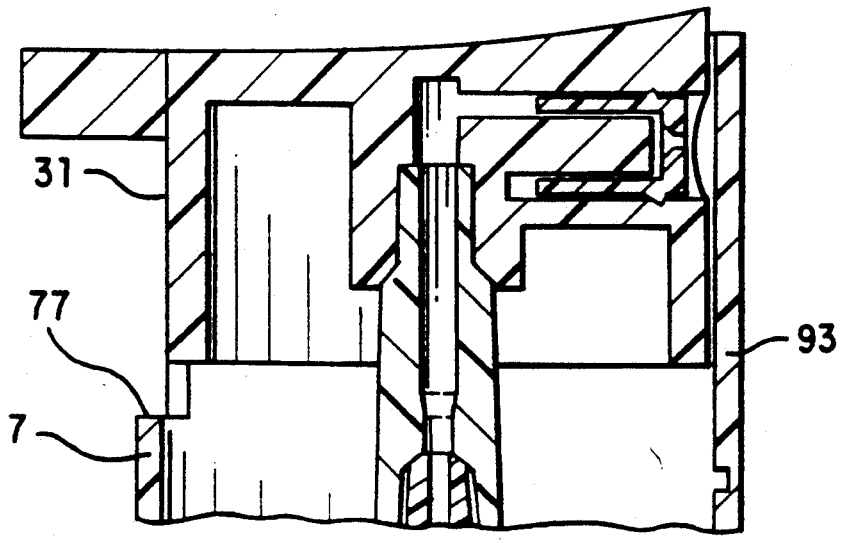
FIG. 6 is a partial cross sectional view of the container and retainer shown in FIG. 4 shown in enlarged scale, with the actuator in an operating position.

An upstanding annular wall 7 upwardly depends from the annular portion 4 at a point located radially outward from wall 5 so as to surround vertical wall 5. In this embodiment, annular wall 7 is formed with openings 71 and 73, which cooperate with fluid dispensing actuator 31, shown mounted on the piston 18 of the modular pump in FIG. 4 and, in more detail, in FIGS. 5 and 6. The actuator is configured similarly to that disclosed in my U.S. Pat. No. 3,848,778, the disclosure of which is expressly incorporated herein by reference. The actuator includes an actuating portion 81 that transmits force applied to the axially outer end of the actuator to the stem of the modular pump to operate the pump and a dispensing orifice 85 through which product is discharged. A radial extension 83 is formed on the actuator opposite the dispensing orifice. The extension 83 projects outwardly over annular wall 7. When, as shown in FIGS. 4 and 5 (in which the retainer is shown in cross section along line B—B of FIG. 2), the actuator is rotated so that extension 83 projects over the axially outer portion 75 of annular wall 7, outer portion 75 blocks axially inward movement of the actuator, thereby preventing product from being dispensed by the modular pump. This is the non-operating position for the actuator. However, when, as shown in FIG. 6, the actuator is rotated so that extension 83 projects over the axially inner portion 77 of annular wall 7, the actuator can be depressed and product can therefore be dispensed by the modular pump. This is the operating position for the actuator.

Figure 3:
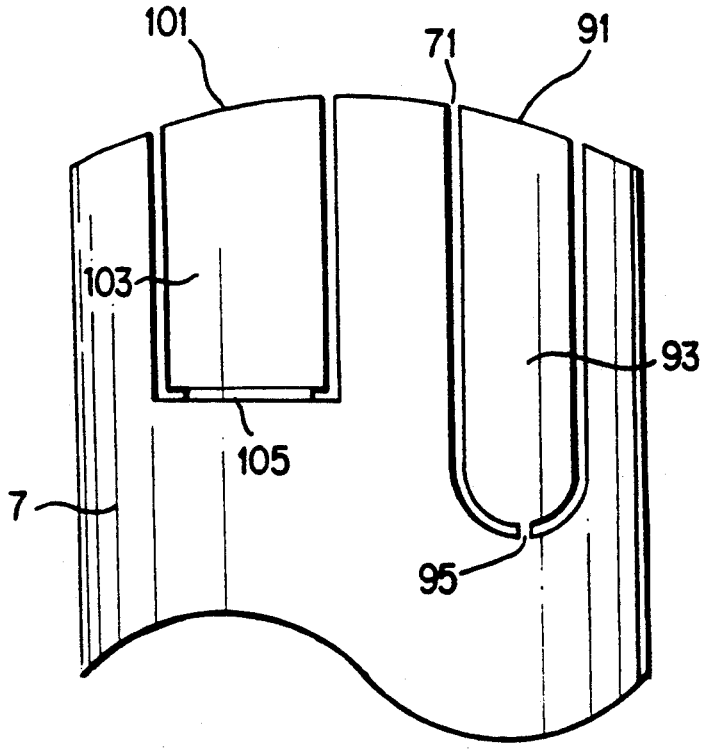
FIG. 3 is a partial elevation view of the retainer shown in FIG. 1.

As shown in FIGS. 2, 3, and 4, opening 71 in annular wall 7 corresponds to the position of the dispensing orifice when the actuator is in the operating position. When the actuator is in the operation position, and the discharge orifice is therefore aligned with opening 71, product can be dispensed from the modular pump via the discharge orifice without obstruction by the annular wall. However, opening 71 is initially covered by a removable tab 91. Removable tab 91 includes a tab portion 93 that is approximately as thick as the annular wall and a frangible portion 95 that is thinner. Before using the container for the first time, the user removes the removable tab by grasping the tab portion 93 and breaking the frangible portion 95.

As shown in FIGS. 3, 4, and 5, a portion of the annular wall 7 is formed as a hinged tab 101. The hinged tab includes a tab portion 103, a hinge portion 105 connecting the axially inner end of tab portion 103 to annular wall 7, and a sealing projection 107 extending radially inwardly from the radially inner side of tab portion 103. The tab portion is of approximately the same thickness as the remainder of the annular wall 7, while the hinge portion is formed with a thinner cross section. The sealing projection is formed as a cylinder projecting from the radially inner side of the tab portion at one end and open at the other end. The outer diameter of the sealing projection is slightly smaller than the inner diameter of the discharge orifice.

As shown in FIG. 4 and in more detail in FIG. 5, when the actuator is in the non-operating position and the hinged tab is in the vertical position shown in FIG. 3, sealing projection 107 sealingly engages discharge orifice 85. The sealing projection inhibits ambient air from contacting, and drying out, residual product in the discharge orifice and the internal passages of the actuator. This avoids clogging of the passages and the orifice. The sealing engagement of the sealing projection and the discharge orifice also serves to inhibit rotation of the actuator from the non-operating position, avoiding accidental rotation of the actuator to the dispensing position and subsequent discharge of the product from the container.

Hinge portion 105 permits the tab portion to be pivoted radially outwardly from its vertical position. To use the container, the user therefore grasps the tab portion and rotates it away from the vertical position until the sealing projection disengages the discharge orifice. The actuator can then be rotated to the operating position and depressed to discharge product. In the illustrated embodiment, the hinge portion connects the axially inner end of the tab portion to the annular wall. Alternatively, the hinged portion could connect one of the vertical edges of the tab portion to the annular wall.

Figure 7:
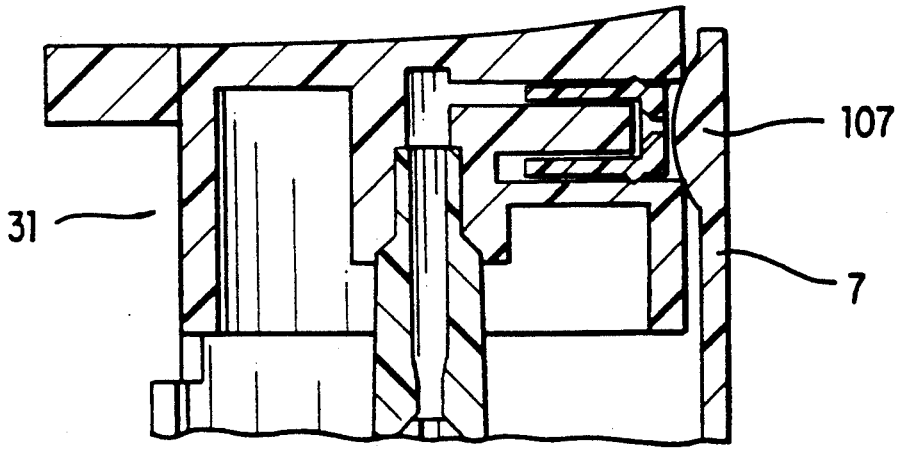
FIG. 7 is a partial cross sectional view of an alternate embodiment of the container and retainer shown in FIG. 4 shown in enlarged scale, with the actuator shown in a non-operating position.

As shown in FIG. 7, the sealing projection can also be formed integrally with the annular wall 7, instead of with a hinged tab. The projection 207 is formed as a rounded, convex shape so that it seals the discharge orifice, but flexure of the annular wall 7 allows a rotative force applied to the actuator 31 to unseat the projection from the orifice and rotate the actuator away from the non-operating position.

The internal configuration of the modular pump 8 may provide for a pre-pressurized type of operation such as that disclosed in my prior U.S. Pat. No. 4,230,242, the disclosure of which is expressly incorporated by reference herein. Thus, reference is made to this patent for a detailed discussion of the internal parts and operation of the pump B. Any other type of dispensing unit known in the art may be employed with the retainer of the invention. However, to obtain full realization of the benefits of the invention, the dispensing unit should be modular, i.e. self-contained, so that it may be assembled to the retainer by merely inserting it into the bore.

Figure 8:
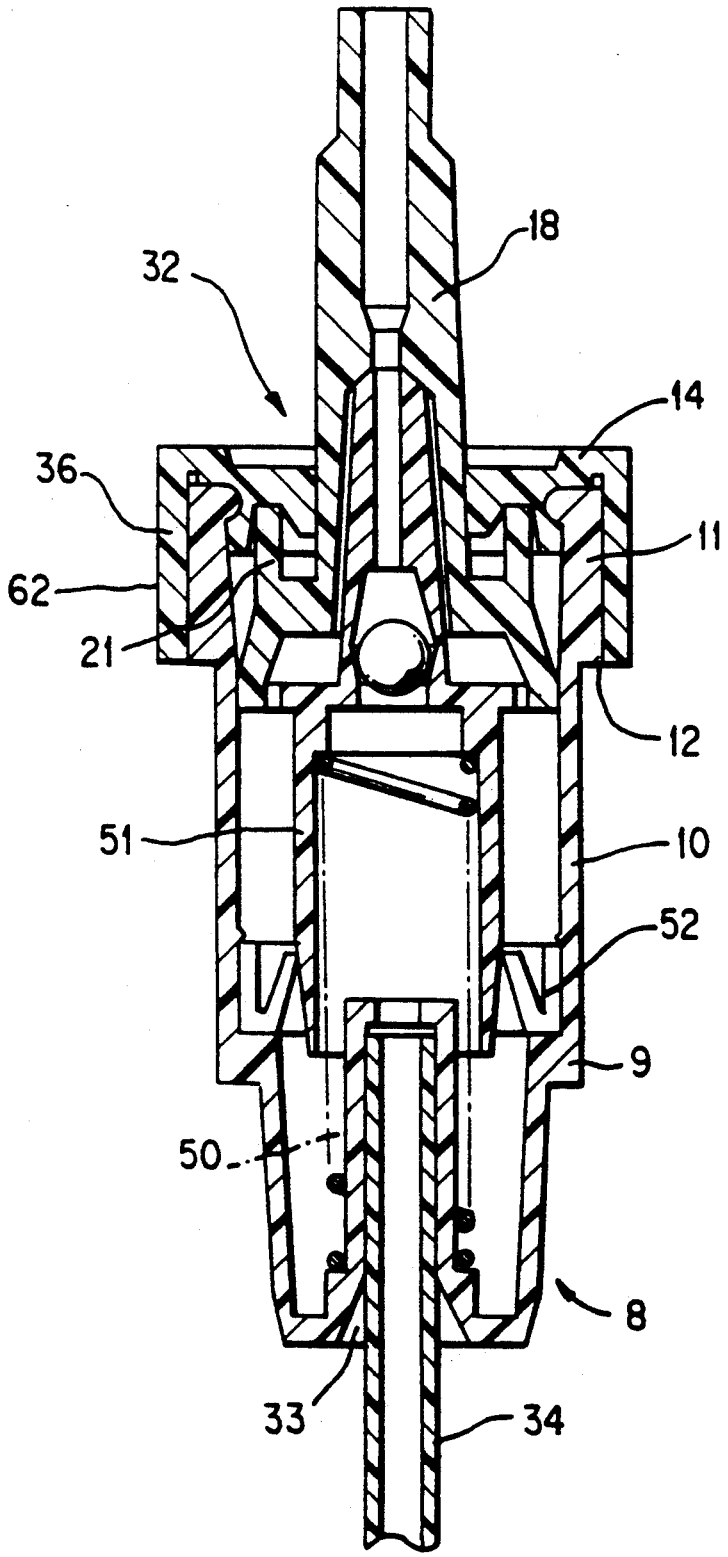
FIG. 8 is a cross sectional view of the modular pump illustrated in FIG. 4 shown in enlarged scale.

As shown in FIG. 8, the modular pump 8 includes a pump housing 9, which has a large opening 32 at one axial end for receiving a piston 18 and other internal parts of the pump, and a small opening 33 at the other axial end into which is inserted a dip tube 34 for supplying the product to be dispensed from the container into the pump. The housing 9 has a small diameter portion 10 and a large diameter portion 11, between which a horizontal step 12 is formed.

Figure 9:
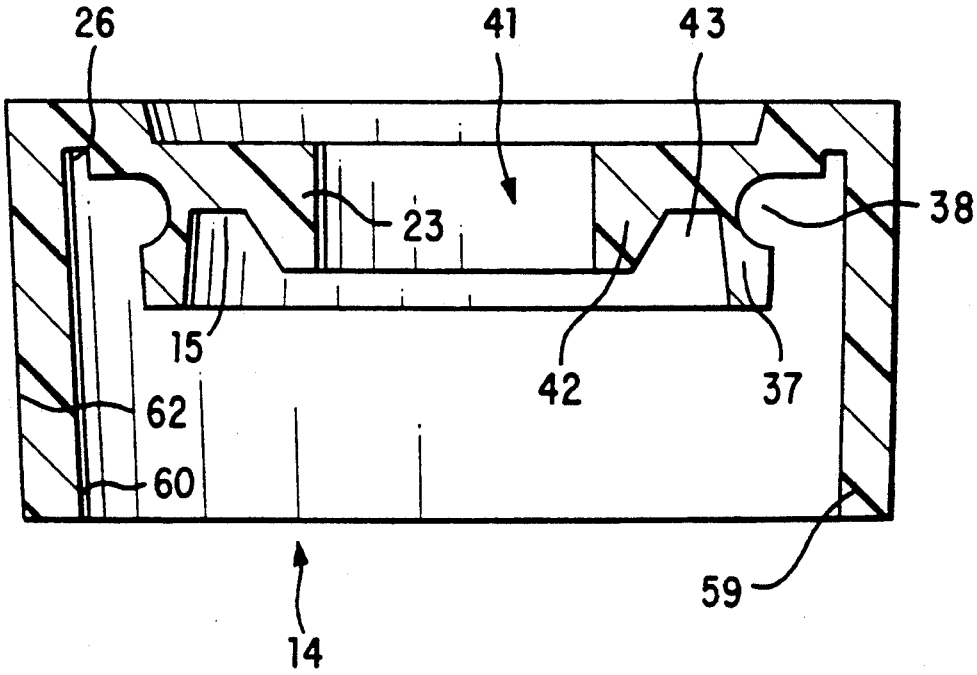
FIG. 9 is a cross sectional view of a top used to seal the open end of the modular pump.

The modular pump 8 includes a separate top 14, shown in more detail in FIG. 9. The top is annular in shape and provides several functions, as discussed below. A central opening 41 is formed through a downwardly depending projection 42 for guiding the piston 18. At the axially inner side of the outer periphery of annular top 14, another downwardly depending projection 37 is formed in spaced relation with projection 42. In the space between these projections an annular recess 43 is formed for sealingly receiving a top surface of piston 18. An annular groove 38 is formed on the radially outer side of projection 37 for sealingly receiving a bead formed on the pump housing 9 to connect the top to the housing.

An annular wall 59 depends axially inwardly from the outer periphery of the annular top. Radially inner surface 60 of annular wall 59 fits tightly over the outer surface 36 of large diameter portion 11 of the pump housing. Radially outer surface 62 of annular wall 59 forms an interference fit with the central surface 6, as described below. An annular notch 26 is provided on the axially inner side of the outer periphery of the top 14 adjacent to the annular wall 59 to form part of a vent path, discussed in more detail below. The radially inner surface 23 of projection 42 is tapered to correspond with tapered surface 22 of piston 18. Inward movement of the piston relative to top 14 opens a small passage between the tapered surfaces that also forms part of the vent path. The top 14 may be formed from a single molded piece of a plastic material.

Figure 10:
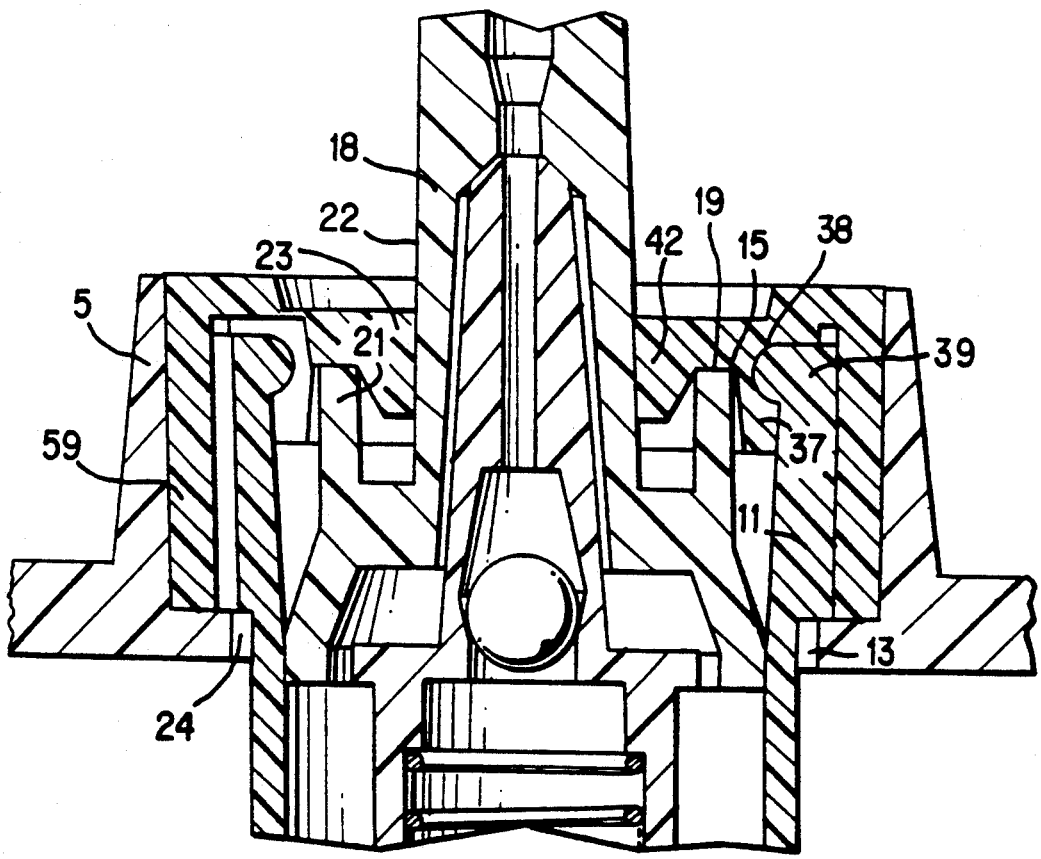
FIG. 10 is a partial cross sectional view of the container, retainer, and modular pump illustrated in FIG. 4 shown in enlarged scale.

As shown in FIG. 10, an annular bead-like projection 39 extends radially inwardly from the inner surface of large diameter portion 11 of the pump housing 9 at the axially outer end thereof. Bead-like projection 39 snap fits into recess 38 to sealingly attach the top 14 to the pump housing. Downward projection 37 and annular wall 59 aid in this sealing function. When fit into the open end 32 of housing 9, top 14 secures all of the pump components within the pump housing, thereby forming a modular pump assembly. This permits the modular pump to be assembled to a variety of different containers, which may be formed from plastic or metal, or to a specially designed mounting cap, such as that disclosed below.

The top surface 19 of the upper cylindrical projection 21 of the piston 18 sealingly contacts an annular surface 15 of the recess 43 when spring 50 urges the valve member 51 and piston 18 outwardly to the unactuated position. A further seal against fluid leakage is provided by the sealing contact between tapered surface 22 of piston 18 and surface 23 of the top 14, which are forced together by spring 50 in the unactuated position of the pump.

As shown in FIGS. 1 and 4, a shoulder 13 is formed at the axially inner end of the central surface 6 of the retainer to correspond to the step 12 between the large diameter portion 11 and the small diameter portion 10 of the pump housing. The pump housing 9 is press fit into the central surface 6 to lock the modular pump in place, and restrain it from moving axially outwardly by virtue of an interference fit formed between the tapered surface 35 of the retainer and the corresponding radially outer surface 62 of the annular wall 59. Modular pump 8 is restrained from moving axially inwardly, which could occur during assembly or when the pump piston is depressed for dispensing, by the stop formed by engagement of the horizontal step 12 and the axially inner end of annular wall 59 with the shoulder 13.

Figure 11:
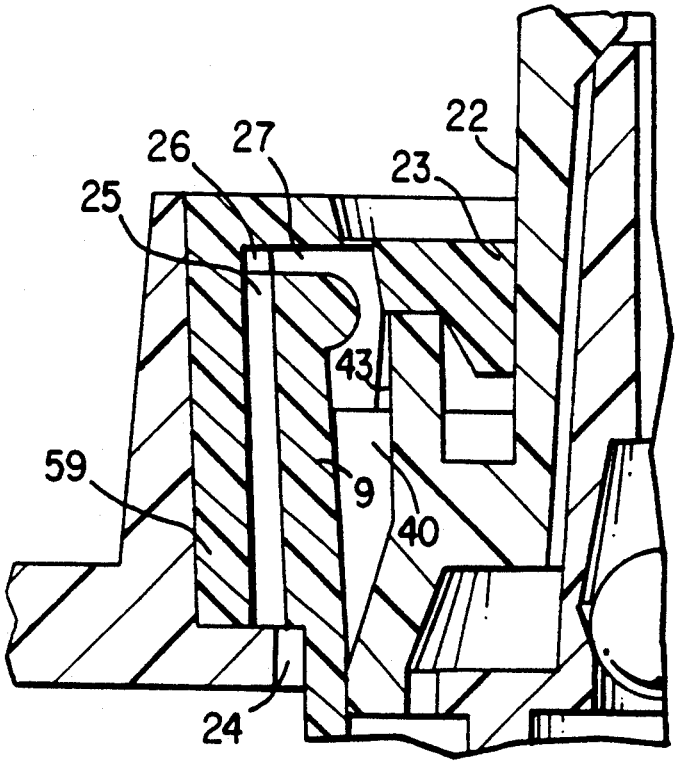
FIG. 11 is partial cross sectional view of the container and retainer of the invention, with a modular pump installed, shown in enlarged scale, illustrating a venting path.

As is known in the art, the modular pump 8 must be provided with a vent path when the product container with which it is used is sealed. Thus, to vent the container to the atmosphere so that ambient air can enter the container to replace the product expelled by the pump during operation, a venting path, similar to that disclosed in my prior U.S. Pat. No. 4,230,242, is provided. In the embodiment illustrated in FIGS. 10 and 11, a vent path is formed by the retainer 1, the pump 8, and the top 14. A vertical slot 25 formed in the outer surface of the pump housing 9 communicates with the space above the product in the container via the annular gap 24 between the radially inner surface of shoulder 13 and the radially outer surface of small diameter portion 10 of the pump housing. The diameter of the inner surface of shoulder 13 is slightly less than the diameter of the radially outer surface 36 of large diameter portion 11 of the pump housing so that the shoulder resists axially inward movement of the pump housing during pump operation and is slightly greater than radial location of the inner side of the vertical slot 25 to allow fluidic communication between the vertical slot and the space above the product in the container.

The annular groove 26 formed at the axially inner side of the periphery of the top communicates with slot 25 and a slot 27 is provided in the top 14 to fluidically couple the annular channel 26 to the annular recess 43. The interior of the container is vented automatically during the operation of the pump, when the piston 18 is displaced inwardly, because ambient air then is allowed to flow between the tapered surface 22 of the piston and the tapered surface 23 of the top into annular recess 43. Since the piston surface 19 moves out of sealing contact with top surface 15, the air can flow from recess 43 through slot 27, annular groove 26, slot 25, and annular gap 24 into the container.

Figure 12:
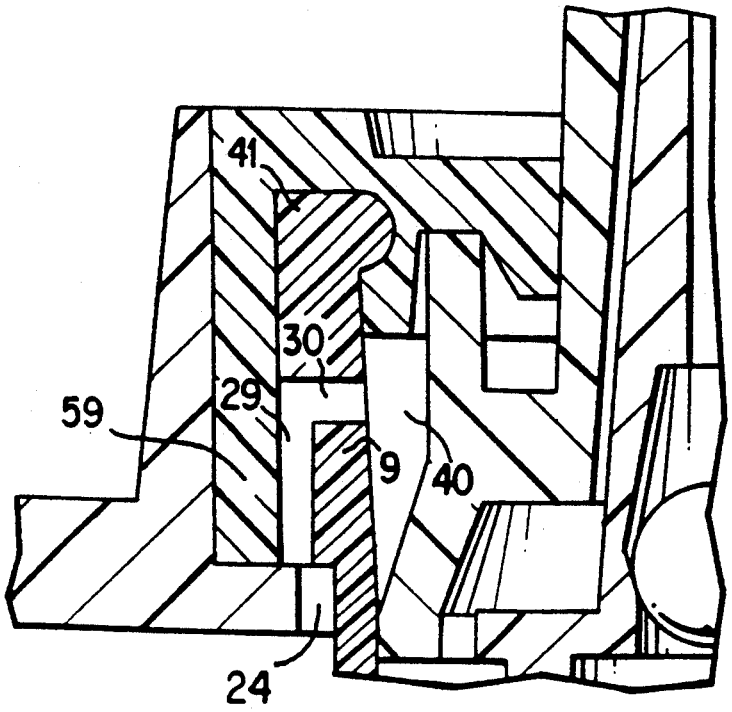
FIG. 12 is a partial cross sectional view of another embodiment of the container and retainer of the invention, with a modular pump installed in the retainer, shown in enlarged scale, illustrating an alternative venting path.

An alternative vent path is illustrated in FIG. 12 in which groove 26 and slot 27 have been eliminated. A vertical slot 29 formed in the outer surface 41 of pump housing 9 extends from annular gap 24 about halfway up large diameter portion 11. Slot 29 communicates with a radial passage 30 formed in the pump housing 9, which connects with a chamber 40 formed between the top 14, pump housing 9, and piston 18. During venting, air enters between the top 14 and piston 18 as the piston is depressed and flows through passage 30, and annular gap 24 into the container.

Modular pump 8 may be constructed advantageously on an automatic assembly line by one or more machines that sequentially insert its component parts into the open end 32 of the pump housing in a single direction. For example, the seal 52, spring 50, valve member 51 and piston 18 may be sequentially dropped into the pump housing 9 from above. The top 14 then is placed over the piston 18 into the opening 32 and around the radially outer surface 36 of large diameter portion 11 of the pump housing to snap fit onto the pump housing, thereby forming a self-supporting, self-contained modular pump assembly. The dip tube may be inserted into the other end of the housing at the beginning or end of the assembly process. After assembly, the unit may be shipped to another manufacturer or user for insertion into a dispensing container. Automatic assembly of dispensers is facilitated as each container and integrally formed retainer may be filled with the product to be dispensed on a product filling line. After filling, a modular pump is press fit from above into the central surface of the retainer to seal the only opening in the container. Because of the interference fit between the pump and retainer, the only way the product can be dispensed is via the pump. The pump cannot be removed nor can any contaminant be introduced into the container without destroying the container. This guarantees the integrity of the product for the entire life of the product.

Alternatively, if this manufacturer or user also produces pumps, after filling of the containers the pump may be assembled by placing the pump housing into the retainer of the invention and then following the order of assembly discussed above. However, the dip tube must be assembled to the pump housing before it is inserted into the container. This alternative also produces a dispenser in which the integrity of the product can be guaranteed throughout the entire life of the product.

With either method of assembly, the illustrated embodiment provides a container that is resistant to accidental discharge. Product cannot be discharged unless the actuator is depressed while in the operating position. The sealing projection on the hinged tab engages the discharge orifice and prevents rotation of the actuator to the operating position. The hinged tab must be rotated away from the actuator before the actuator can be turned. Even when the actuator is rotated to the operating position, product discharged from the discharge orifice is blocked by the removable tab until the user has broken the removable tab from the upstanding annular wall.

The illustrated embodiment also inhibits clogging of the actuator's internal passages and the discharge orifice by dried residual product after dispensing. The sealing engagement of the sealing projection with the discharge orifice inhibits the passage of ambient air into the discharge orifice.

Figure 13:
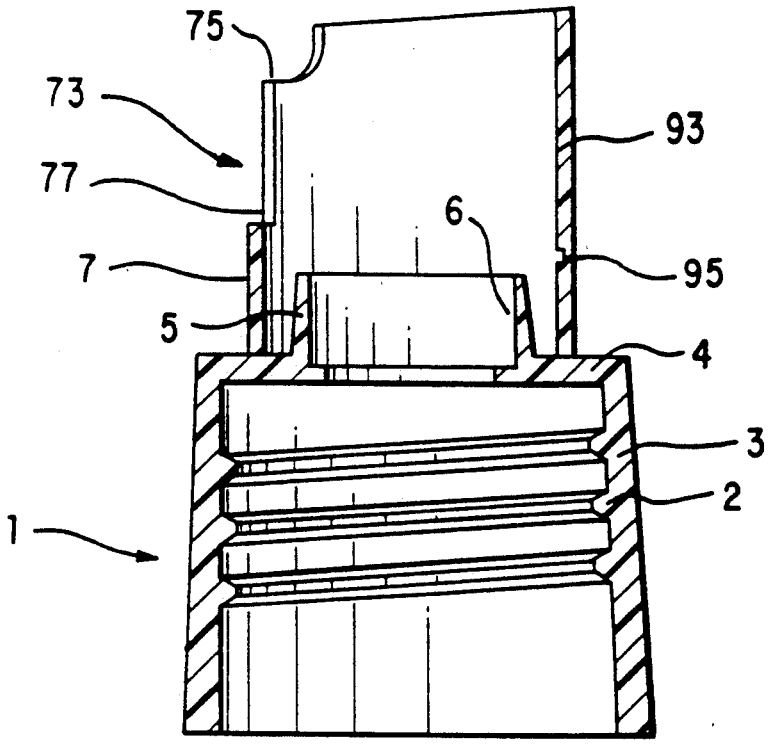
FIG. 13 is a cross sectional view of a mounting cap constructed according to a second embodiment of the present invention.
Figure 14:
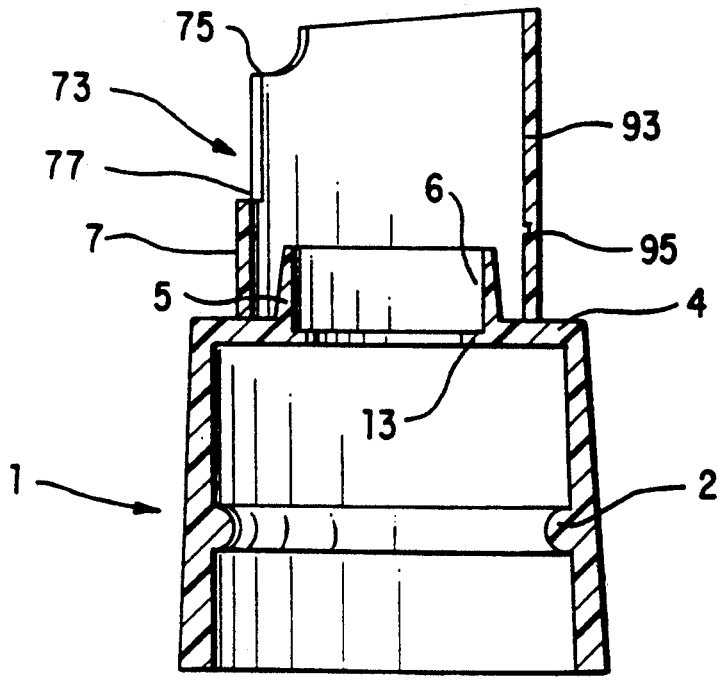
FIG. 14 is a cross sectional view of the mounting cap of FIG. 13 with an alternate mechanism for attachment to a container.

As noted above, many of the features of the illustrated embodiment can advantageously be employed separately in combination with existing dispenser designs. For example, as shown in FIG. 13, the retainer, with the structure for retaining the pump and the upstanding annular wall with the hinged tab, removable tab, and actuator locking structure, can be formed as a separate mounting cap that can be attached to a container with conventional threaded or snap attachment. The mounting cap 1 may be formed as a single molded piece of a plastic material formed with integral structure to secure it to the open end of the container. This structure may comprise internal threads 2 formed on the inside of a side wall 3 having a cylindrical or slightly frusto-conical cross section. Extending radially inwardly from the side wall 3 is the horizontal portion 4. The remainder of the structure is the same as that described above for the first embodiment. Alternatively, as shown in FIG. 14, the attachment structure can comprise a conventional snap attachment, using annular bead 2 formed on the radially inner surface of sidewall 3 to engage in a snap fit with a mating structure on the neck of a container.

Figure 15:
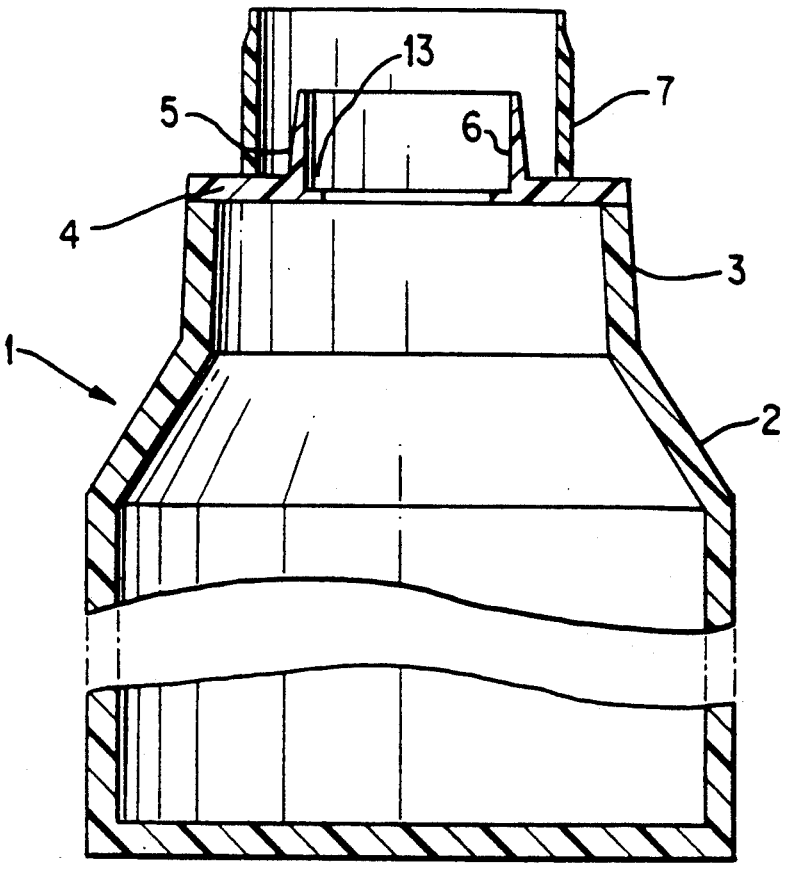
FIG. 15 is a cross sectional view of a simplified retainer constructed according to the principles of the invention.

The structure for retaining a modular pump mounted from the axially outer side of the container can be employed in either a mounting cap embodiment or an integral container neck embodiment without the upstanding annular wall and its associated hinged tab, removable tab, and actuator locking structures. This is illustrated in FIGS. 15, where the pump retainer is integrally formed with the container. Upstanding annular wall 7 can be truncated to served as a guide for a conventional actuator or can be eliminated altogether.

Figure 16:
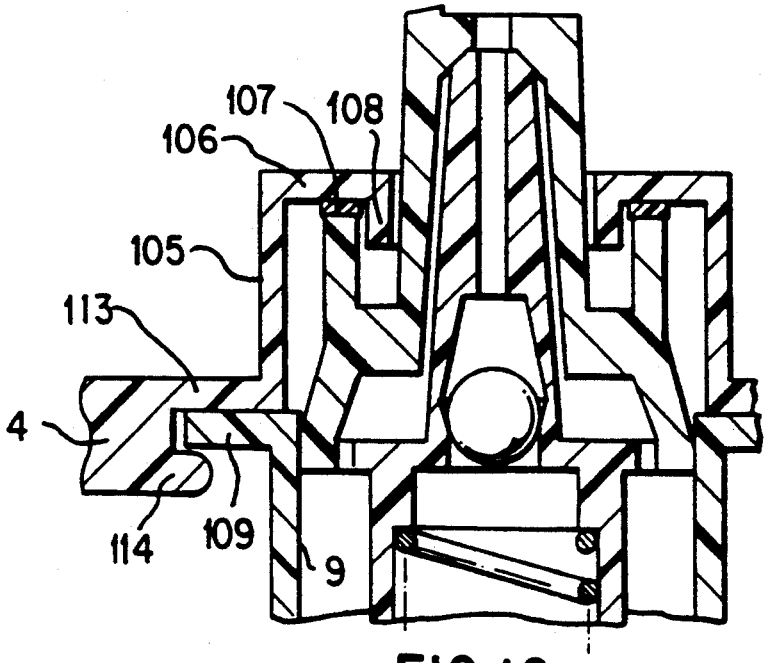
FIG. 16 is a cross sectional view of a mounting cap constructed according to a third embodiment of the present invention.

Conversely, in a mounting cap embodiment, the annular wall and associated structures can be employed with a pump retention structure in which a non-modular dispensing pump is mounted in the mounting cap from its axially inner side in conventional manner before assembly onto the bottle body. Such a pump retention structure is illustrated in FIG. 16. The pump housing 9 is formed with a flange 109. Horizontal portion 4 is formed with an annular lip 114 and a shoulder 113. In assembling the pump to the retainer, the flange 109 is snap fit between the lip 114 and the shoulder 113. Annular wall 105 includes a horizontal annular portion 106 and a rim 108 that engages annular projection 21 of the piston. A gasket 107 provides a seal between annular projection 21 and the axially inner surface of annular portion 106.

What is claimed is:

1. A dispensing unit retainer comprising:

a. a horizontal portion having a radially inner periphery and a radially outer periphery;

b. a generally cylindrical sidewall portion downwardly depending from said outer periphery, said sidewall portion including a screw thread for securing the dispensing unit retainer to a container;

c. a circumferential surface at said inner periphery for retaining a dispensing unit via an interference fit therebetween, said surface having an axially outer end of a first diameter and an axially inner end of a second diameter smaller than said first diameter, said surface tapering radially inwardly from said axially outer end to said axially inner end;

d. a stop formed at said axially inner end of said surface for locating a dispensing unit retained in said retainer in a predetermined axial position;

e. an upstanding annular wall depending upwardly from said horizontal portion, said upstanding annular wall having at least first and second openings therein for cooperating with an actuator of a dispensing unit retained within the retainer to selectively permit dispensing;

f. a removable tab essentially filling said first opening connected to said upstanding annular wall.

2. The dispensing unit retainer of claim 1 wherein said sidewall portion has a radially inner surface and said screw thread is formed on said radially inner surface.

3. A locking device comprising:

a base portion;

an opening in said base portion for receiving in said base portion a dispensing pump with an attached dispensing pump actuator having a discharge orifice;

an annular wall extending from said base portion;

an opening in said annular wall defining a dispensing position for the actuator;

a radially outwardly moveable hinged tab on said annular wall, said hinged tab having a radially inner surface and being circumferentially spaced from said opening in said annular wall, said hinged tab defining a locked position for the actuator;

a radially inwardly extending projection on said hinged tab;

said projection including an outer wall extending perpendicularly to the radially inner surface of said tab, said outer wall engaging an inner wall of the discharge orifice so as to inhibit rotation of the actuator from said locked position to said dispensing position until said hinged tab is moved radially outwardly, said projection further sealing said discharge orifice when the outer wall of the projection engages the inner wall of the discharge orifice.

4. The locking device of claim 3, wherein:

said locking device is constructed of a molded plastic material.

5. The locking device of claim 3, further comprising:

a removable tab in said opening connected to said annular wall.

6. The locking device of claim 5, wherein:

said removable tab comprises a thick portion and a thin frangible portion, said thin frangible portion connecting said annular wall and said removable tab.

7. The locking device of claim 3, wherein:

said hinged tab is connected to said annular wall by a hinge.

8. The locking device of claim 7, wherein:

said hinge is of a thinner cross section than said annular wall or said hinged tab.

9. The locking device of claim 3, further comprising:

a further opening in said annular wall opposite said opening, said further opening allowing an extension on said actuator to move therein.

* * * * *